US006626733B1

(12) United States Patent
Knutson

(10) Patent No.: US 6,626,733 B1
(45) Date of Patent: Sep. 30, 2003

(54) SPORTS TOP WITH BUILT-IN BOTTLE HOLDER

(76) Inventor: David Knutson, 6615 Kilberry La., Charlotte, NC (US) 28277

( * ) Notice: Subject to any disclaimer, the term of this patent is extended or adjusted under 35 U.S.C. 154(b) by 0 days.

(21) Appl. No.: 10/389,524

(22) Filed: Mar. 14, 2003

(51) Int. Cl.[7] ..... A41C 3/00
(52) U.S. Cl. ..... 450/89; 2/247; 224/148.1
(58) Field of Search ..... 450/1, 89, 7, 8, 450/9, 10, 11, 65, 66, 67, 74–76; 2/105, 106, 69, 108, 102, 85, 93–95, 247–253; 224/148.1, 148.2, 148.4, 148.5, 148.6, 148.7

(56) References Cited

U.S. PATENT DOCUMENTS 4,564,957 A * 1/1986 Scharf ..... 2/75
5,815,834 A * 10/1998 Bronson ..... 2/102
5,909,802 A * 6/1999 Puco et al. ..... 2/102
5,913,409 A * 6/1999 Test ..... 2/102
5,940,883 A * 8/1999 Daoust ..... 2/102
5,960,471 A * 10/1999 Burton ..... 2/48
6,055,668 A * 5/2000 Gros et al. ..... 2/69
6,241,575 B1 * 6/2001 Shailer ..... 450/38
6,343,727 B1 * 2/2002 Leach ..... 224/158

* cited by examiner

*Primary Examiner*—Gloria M. Hale
(74) *Attorney, Agent, or Firm*—Schwartz Law Firm, P.C.

(57) ABSTRACT

A sports top is adapted for releasably holding a fluid container. The sports top includes a body fabric for being worn on an upper torso of a wearer. The body fabric has a front and back joined together and defining a pair of armholes and a neckhole. A pocket panel is formed with the back of the body fabric, and cooperates with the body fabric to form a pocket. The pocket has an open mouth, closed sides, and a bottom. A shape-retaining insert opens the mouth of the pocket such that the fluid container is readily inserted by the wearer into the pocket of the sports top during wear.

20 Claims, 6 Drawing Sheets

SPORTS TOP WITH BUILT-IN BOTTLE HOLDER

TECHNICAL FIELD AND BACKGROUND OF INVENTION

This application relates to a sports top with a built-in bottle holder. The invention is especially applicable for wear when running, playing sports, bicycling, rollerblading, hiking, or during other aerobic activity where breaking for water is generally inconvenient and causes premature lowering of the heart rate below a target exercise level. The invention resembles a conventional woman's sports top, is comfortable, and provides ready access to a water bottle carried in the built-in holder. The built-in holder locates the water bottle at the back of the wearer in an area between the shoulder blades to avoid interfering with moving arms and legs. The water bottle is quickly and easily removed from and reinserted into the pocket with little effort and inconvenience. In an alternative embodiment, the invention may be constructed in the form of a body shirt or tank top for men.

Garment tops with pockets for carrying articles are well known in the prior art. One such garment described in pending U.S. patent application Ser. No. 10/054,172 includes a pocket formed with a back of the top, and located above and between the shoulder blades of the wearer. The pocket has a mouth through which an article, such as a portable music device, is received and stored. The mouth of the pocket may be closed using a cover flap, button, hook and loop fastener, or other closure means. According to this prior art, for garments made of an elastic material, no closure is generally required as the fabric contours to the item causing the stowed item to fit snugly against the body. While this garment provides generally safe and secure storage of items in the pocket, it would be impractical, if not impossible, to readily access, remove, and reenter these items in the pocket while performing an aerobic activity.

The present invention addresses this and other limitations of the prior art by providing a sports top adapted for carrying a water bottle for ready and convenient access, and allowing quick and easy reinsertion of the bottle into a built-in pocket formed with a back of the sports top.

SUMMARY OF INVENTION

Therefore, it is an object of the invention to provide a sports top which includes a built-in pocket for holding a water bottle.

It is another object of the invention to provide a sports top which allows ready access to a water bottle while exercising.

It is another object of the invention to provide a sports top which is applicable for wear by both men and women.

It is another object of the invention to provide a sports top which releasably holds a water bottle against the body in a location for optimal comfort and access.

It is another object of the invention to provide a sports top which securely retains the water bottle in a stable condition when exercising.

It is another object of the invention to provide a sports top which is comfortable to wear.

It is another object of the invention to provide a sports top which allows quick and easy reinsertion of the water bottle into the built-in pocket simultaneously while exercising.

These and other objects of the present invention are achieved in the embodiments disclosed below by providing a sports top adapted for releasably holding a fluid container. The sports top includes a body fabric for being worn on an upper torso of a wearer. The body fabric has a front and back joined together and defining a pair of armholes and a neckhole. A pocket panel is formed with the back of the body fabric, and cooperates with the body fabric to form a pocket. The pocket has an open mouth, closed sides, and a bottom. Means are provided for opening the mouth of the pocket such that the fluid container is readily inserted by the wearer into the pocket of the sports top during wear.

The term "sports top" is used broadly herein to mean any garment applicable for partially or entirely covering the torso of a wearer.

The term "container" refers to any structure capable of holding a fluid.

According to another preferred embodiment of the invention, an insulating layer is located between the body fabric and the pocket panel.

According to another preferred embodiment of the invention, the insulating layer includes polyester fibers.

According to another preferred embodiment of the invention, the back of the body fabric has a generally v-shaped neckline.

According to another preferred embodiment of the invention, the pocket panel is sewn to the back of the body fabric and extends above a bottom point of the v-shaped neckline.

According to another preferred embodiment of the invention, the means for opening the mouth of the pocket is a curved, shape-retaining insert located adjacent the bottom point of the v-shaped neckline.

Alternatively, the "means for opening" may include any other suitable structure creating slight separation of fabric at the mouth of the pocket such that a base of the fluid container is readily inserted into the pocket. The structure may be a similarly formed semi-rigid or rigid insert, or a stitch pattern forming a puckering of fabric or pleat.

According to another preferred embodiment of the invention, an insert liner is sewn to an inside of the back of the body fabric, and is adapted for containing and positioning the insert at the mouth of the pocket.

According to another preferred embodiment of the invention, an insulating layer is located between the insert liner and the pocket panel. The insulating layer is sewn to the pocket panel such that the fluid container resides between the insert liner and the insulating layer when positioned in the pocket of the sports top during wear.

According to another preferred embodiment of the invention, the body fabric includes elastic fibers.

According to another preferred embodiment of the invention, the body fabric includes first and second shoulder straps for supporting the front and back in position on the wearer.

According to another preferred embodiment of the invention, the pocket panel is sewn to an inside of the back of the body fabric, and has first and second shoulder extensions sewn to respective shoulder straps of the body fabric.

In another preferred embodiment, the invention is a garment adapted for releasably holding a fluid container. The garment includes a body fabric for being worn by a wearer. A pocket panel formed with the body fabric. The pocket panel cooperates with the body fabric to form a pocket. The pocket includes a container-receiving mouth and attached sides. Means are provided for opening the mouth of the pocket such that the fluid container is readily inserted by the wearer into the pocket of the garment during wear.

In another embodiment, the invention is a method for carrying a beverage while jogging. The method includes the steps of wearing a sports top and inserting a fluid container in a pocket formed with the sports top. The pocket has a mouth and means for opening the mouth to allow ready insertion of the fluid container in the pocket while jogging. The fluid container is removed from the pocket for drinking. After drinking and while jogging, the fluid container is reinserted in the pocket through the open mouth of the pocket.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
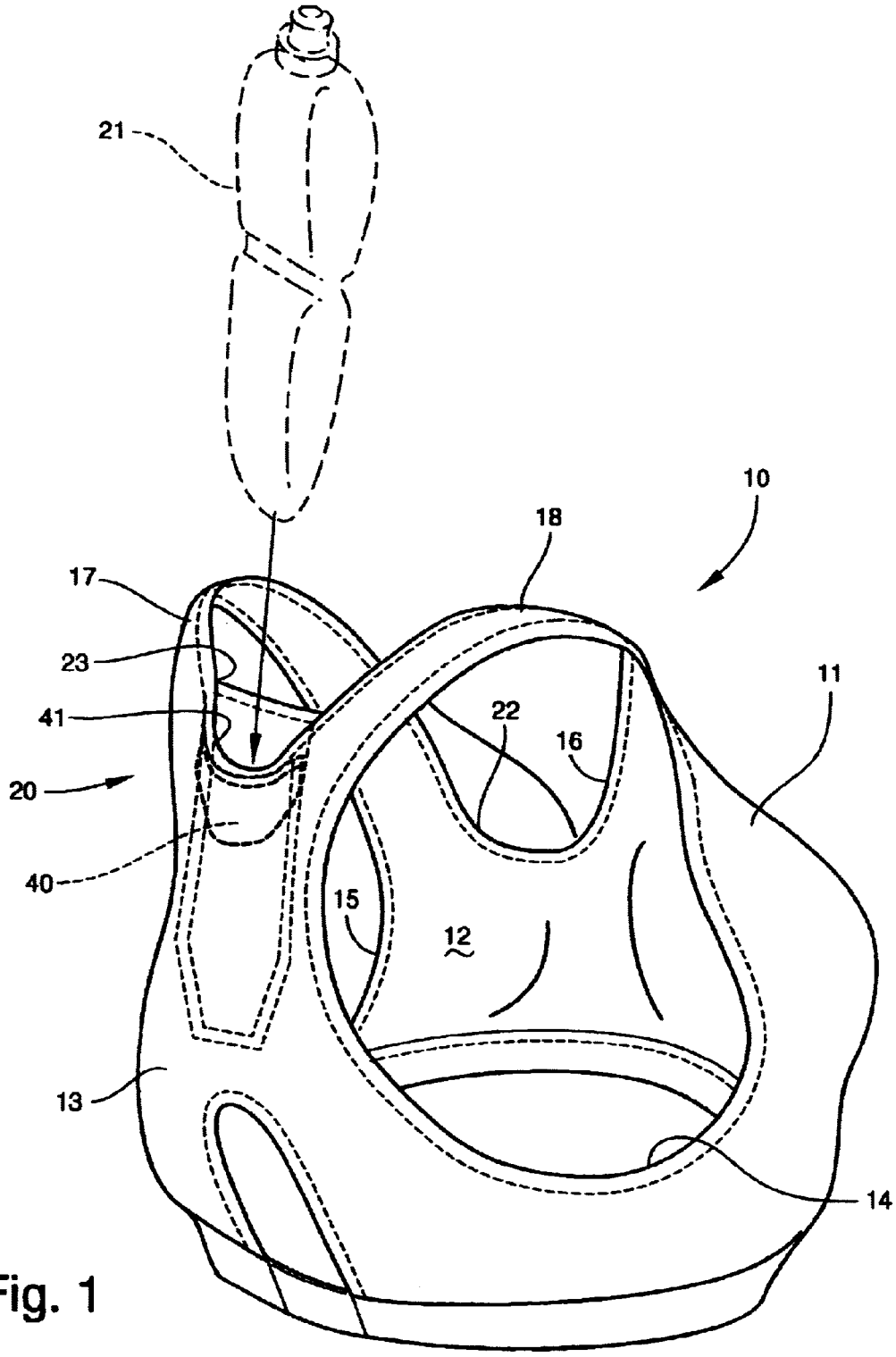
FIG. 1 is a perspective view of the sports top according to one preferred embodiment of the invention, and showing the water bottle in phantom removed from the pocket.
Figure 2:
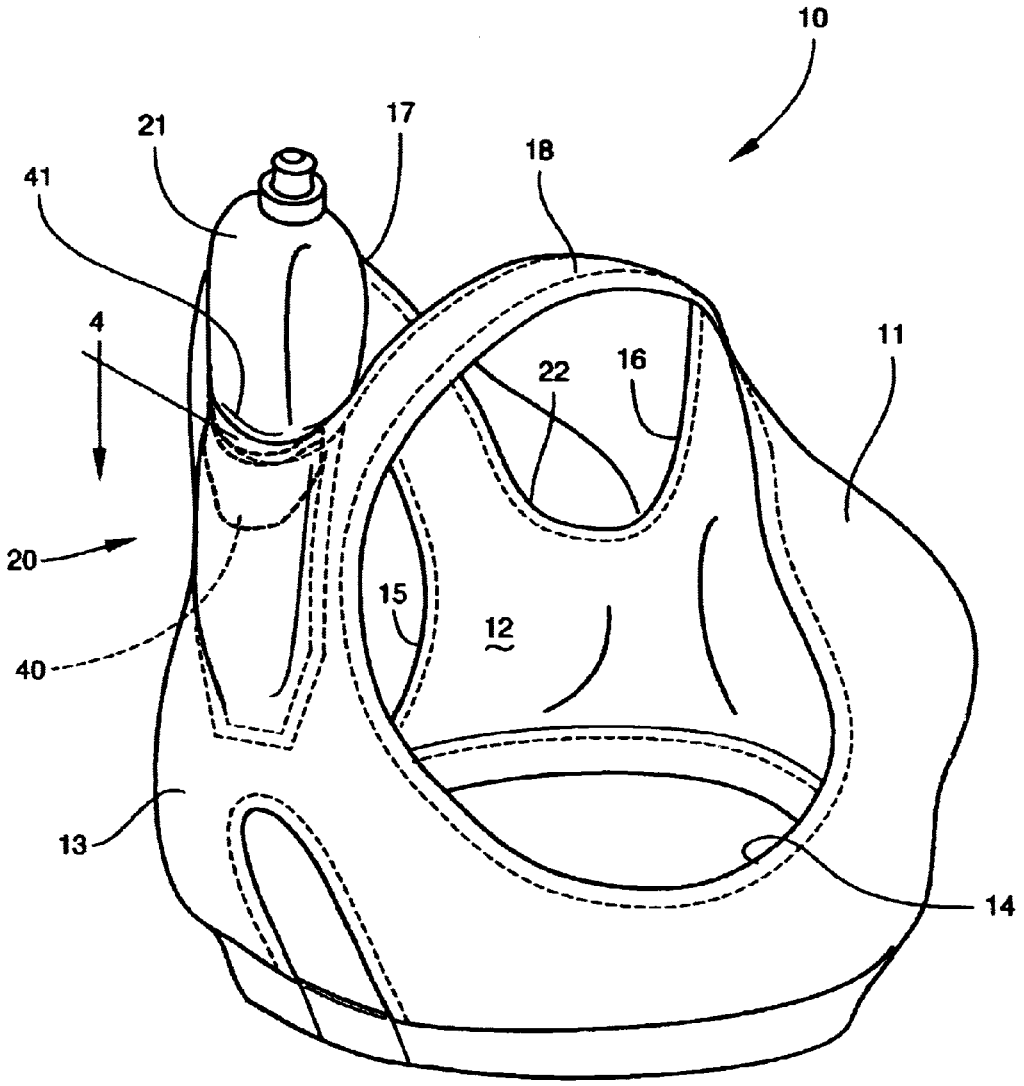
FIG. 2 is a perspective view of the sports top showing the water bottle carried in the pocket.

Referring now specifically to the drawings, a sports top according to the present invention is illustrated in FIG. 1, and shown generally at reference numeral 10. The sports top 10 is constructed of an elastic body fabric 11, such as spandex or Lycra®, and includes an integrally formed front 12 and back 13 defining a pair of arm holes 14 and 15 and a neckhole 16. Shoulder straps 17 and 18 extend between the front and back 12 and 13, and serve to support and position the body fabric 11 on the upper torso of the wearer. An elastic pocket 20 is located at the back 13 of the sports top 10 and is uniquely designed for holding a fluid container, such as the plastic water bottle 21 shown in FIGS. 1 and 2. In the embodiment shown, the sports top 10 has a standard rounded front neckline 22, a generally v-shaped back neckline 23, and otherwise closely resembles a conventional woman's sports bra. The sports top 10 is especially applicable for wear while running, bicycling, playing sports, and other aerobic activity.

Figure 3:
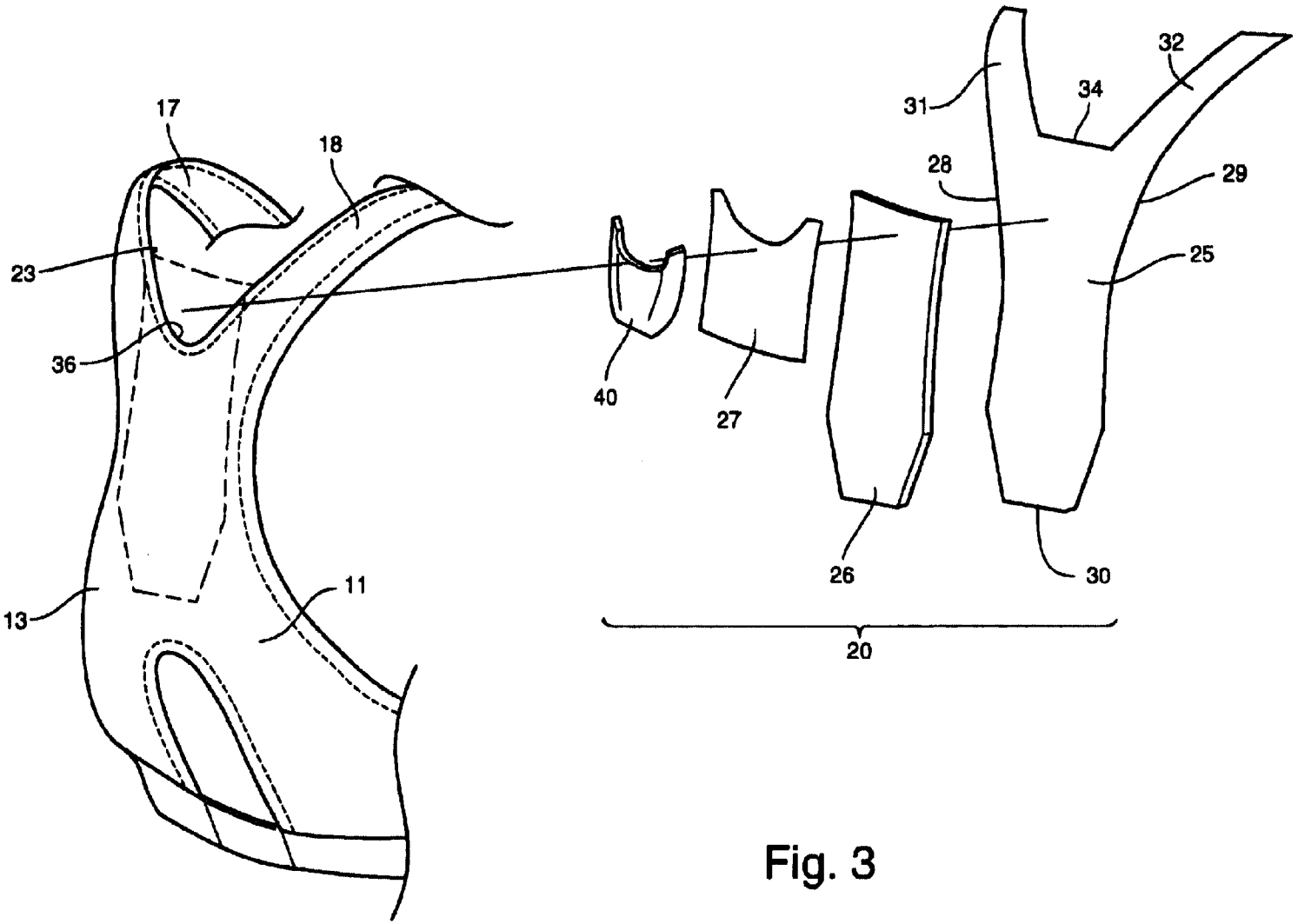
FIG. 3 is a fragmentary perspective view of the sports top showing elements of the back pocket exploded away.
Figure 4:
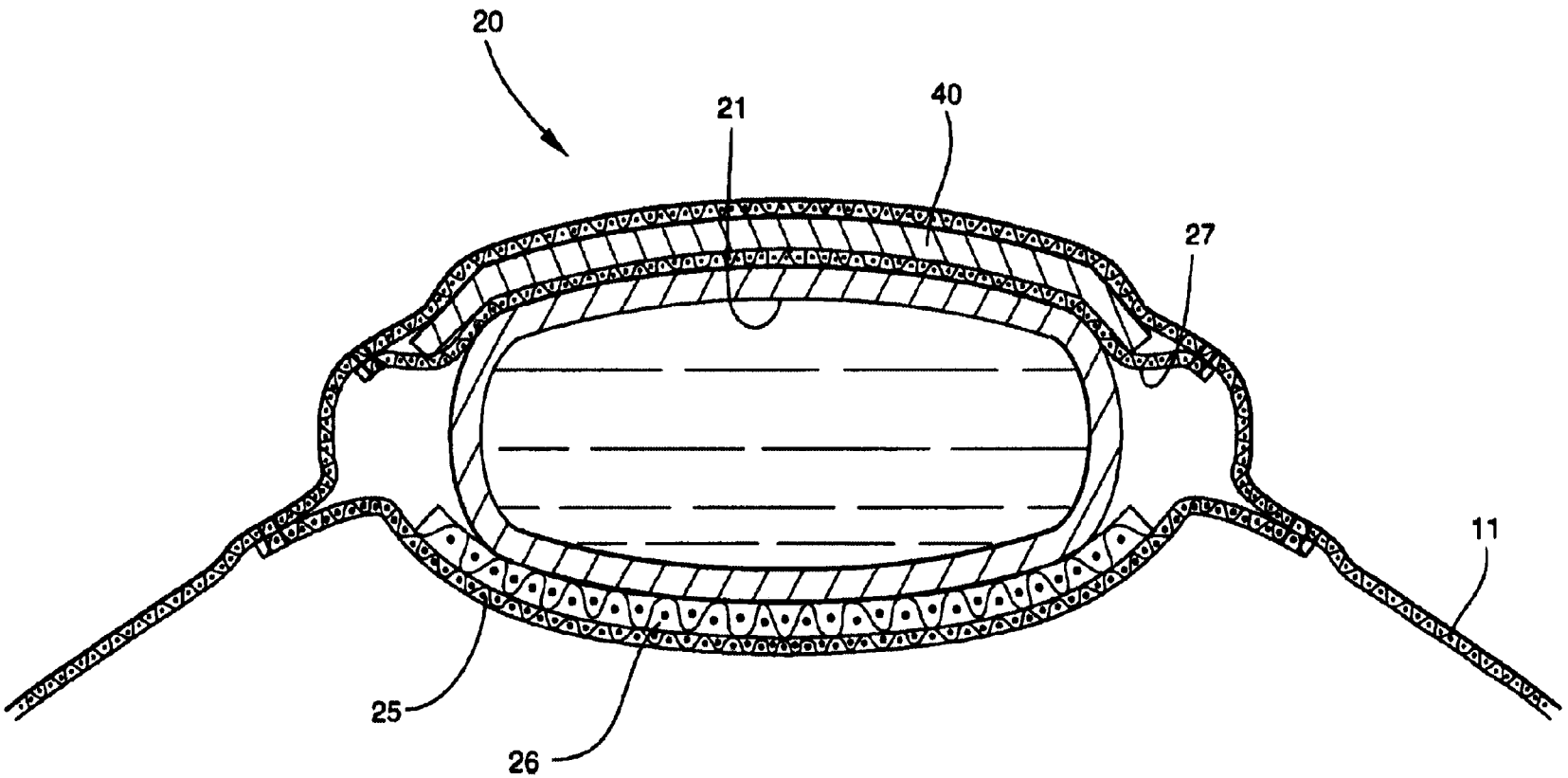
FIG. 4 is an enlarged cross-sectional view taken substantially along line 4 in FIG. 2.
Figure 5:
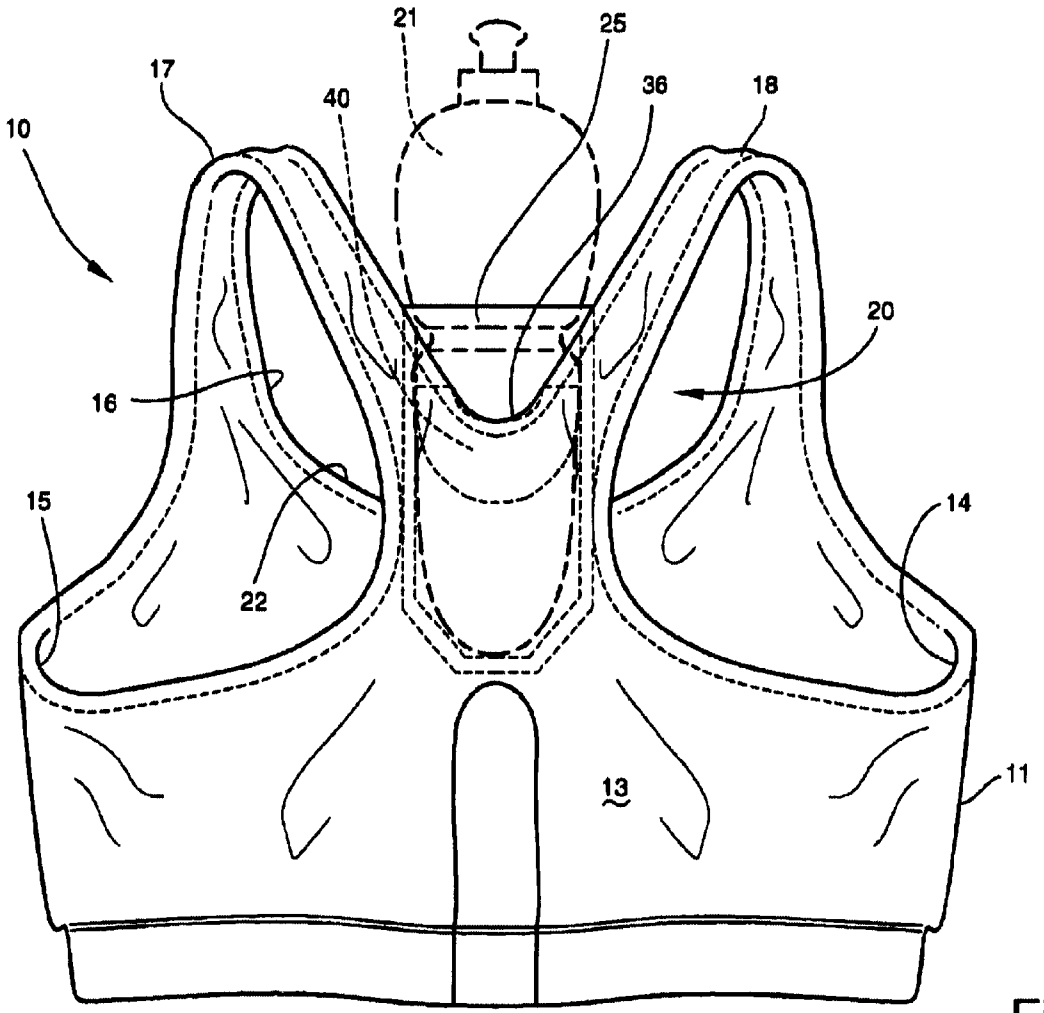
FIG. 5 is a back view of the sports top with the water bottle shown in phantom.
Figure 6:
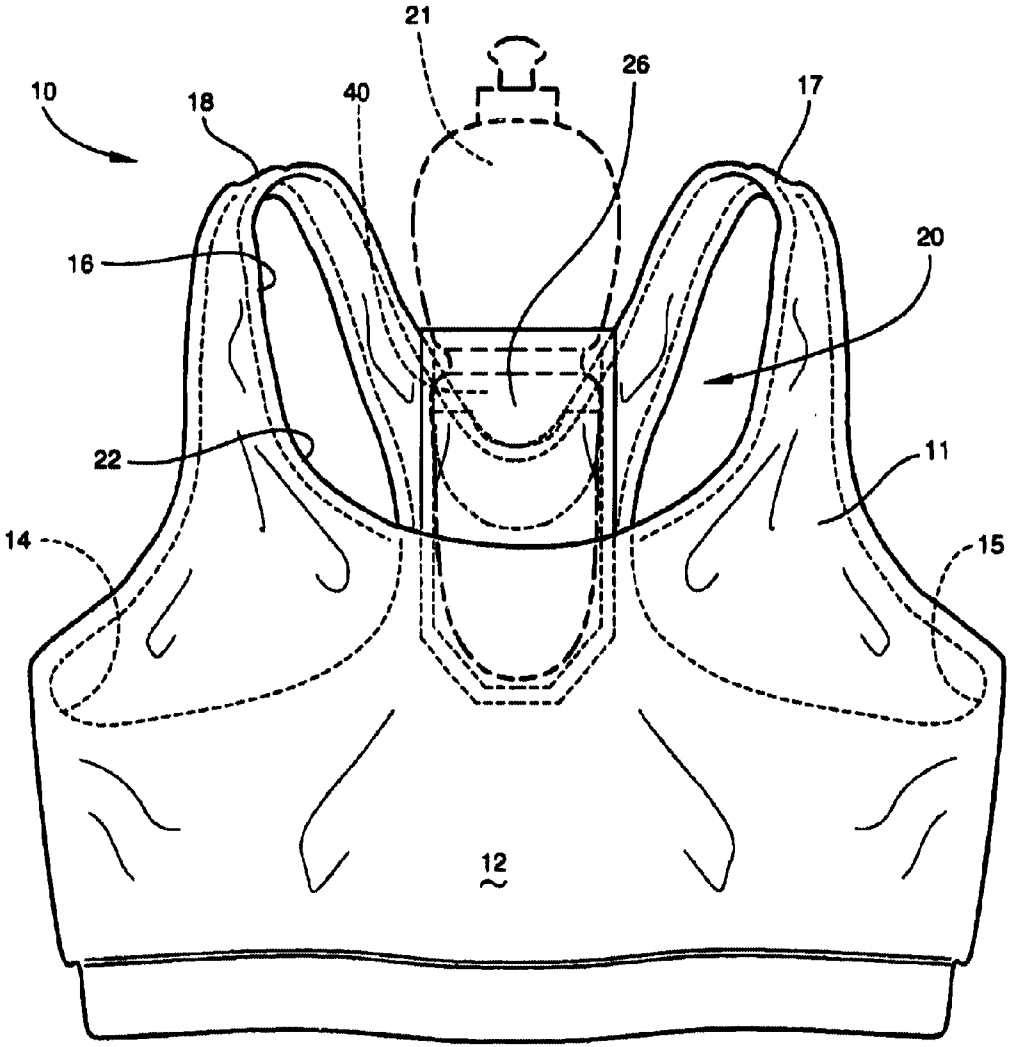
FIG. 6 is a front view of the sports top with the water bottle shown in phantom.

As best shown in FIGS. 3 and 4, the pocket 20 is formed of an assembly of elastic fabric layers including a generally Y-shaped pocket panel 25, a relatively thin insulating layer 26, and an insert liner 27. The pocket panel 25 is sewn to the inside of the body fabric 11 along its opposing side edges 28, 29 and bottom edge 30, and includes first and second integrally formed extensions 31 and 32 sewn to respective shoulder straps 17 and 18 for adding support strength to the pocket 20. The pocket panel 25 cooperates with the body fabric 11 to form attached sides and a bottom of the pocket 20. The square top 34 of the pocket panel 25 extends above a point 36 of the v-shaped back neckline 23, as shown in FIGS. 5 and 6, to create a comfort barrier between the plastic water bottle 21 and the skin of the wearer.

The insulating layer 26 is sewn directly to the pocket panel 25 and extends from the square top 34 downwardly to the bottom of the pocket 20 and outwardly to the pocket sides to further shield the water bottle 21 from the wearer. According to one embodiment, the insulating layer 26 comprises polyester fibers such as those used in Thinsulate™ Flex insulation manufactured by 3M of St. Paul, Minn. Thinsulate™ Flex stretches 40% in all directions and recovers, and is especially designed for lamination to stretch fabrics. Thinsulate™ Flex is breathable, moisture-resistant, and machine washable.

The insert liner 27 is sewn along its entire perimeter edge to an inside of the body fabric 11, and cooperates with the body fabric 11 to contain and position a curved shape-retaining plastic insert 40 at a mouth 41 of the pocket 20. See FIGS. 1, 2, 5, and 6. The plastic insert 40 opens the mouth 41 of the pocket 20 when the sports top 10 is stretched around the upper torso, such that the water bottle 21 is readily inserted into the pocket 20 while running without slowing or disrupting the pace of the wearer. Preferably, the plastic insert 40 is located at the point 36 of the v-shaped back neckline 23, and floats between the body fabric 11 and the insert liner 27.

The water bottle 21 is carried by the wearer in the pocket 20 of the sports top 10, and is designed for convenient access and use when running. Without breaking stride, the user simply reaches over her shoulder, grabs the top of the water bottle 21, and removes it from the pocket 20 of the sports top 10. After drinking, the user replaces the bottle 21 by reaching back over her shoulder, and sliding the tapered base of the bottle 21 downwardly against the insulating layer 26 at the top of the pocket panel 25. The bottle 21 reenters the pocket through the mouth opening created by the shape-retaining insert. The curved shape and rigidity of the insert facilitate reentry of the bottle into the pocket.

A sports top is described above. Various details of the invention may be changed without departing from its scope. Furthermore, the foregoing description of the preferred embodiment of the invention and best mode for practicing the invention are provided for the purpose of illustration only and not for the purpose of limitation-the invention being defined by the claims.

I claim:

1. A sports top adapted for releasably holding a fluid container, comprising:

(a) a body fabric for being worn on an upper torso of a wearer, and comprising a front and back joined together and defining a pair of armholes and a neckhole;

(b) a pocket panel formed with the back of said body fabric, and cooperating with said body fabric to form a pocket, said pocket comprising a container-receiving mouth and attached sides; and (c) means for opening the mouth of said pocket such that the fluid container is readily inserted by the wearer into said pocket of said sports top during wear.

2. A sports top according to claim 1, and comprising an insulating layer located between said body fabric and said pocket panel.

3. A sports top according to claim 2, wherein said insulating layer comprises polyester fibers.

4. A sports top according to claim 1, wherein the back of said body fabric comprises a generally v-shaped neckline.

5. A sports top according to claim 4, wherein said pocket panel is sewn to the back of said body fabric and extends above a bottom point of said v-shaped neckline.

6. A sports top according to claim 5, wherein said means for opening the mouth of said pocket comprises a curved, shape-retaining insert located adjacent the bottom point of said v-shaped neckline.

7. A sports top according to claim 6, and comprising an insert liner sewn to an inside of the back of said body fabric, and adapted for containing and positioning said insert at the mouth of said pocket.

8. A sports top according to claim 7, and comprising an insulating layer located between said insert liner and said pocket panel, said insulating layer being sewn to said pocket panel such that the fluid container resides between said insert liner and said insulating layer when positioned in the pocket of the sports top during wear.

9. A sports top according to claim 1, wherein said body fabric comprises elastic fibers.

10. A sports top according to claim 1, wherein said body fabric comprises first and second shoulder straps for supporting the front and back in position on the wearer.

11. A sports top according to claim 10, wherein said pocket panel is sewn to an inside of the back of said body fabric, and comprises first and second shoulder extensions sewn to respective shoulder straps of the body fabric.

12. In combination with a fluid container, a sports top adapted for releasably holding said fluid container, said sports top comprising:

(a) a body fabric for being worn on an upper torso of a wearer, and comprising a front and back joined together and defining a pair of armholes and a neckhole;

(b) a pocket panel formed with the back of said body fabric, and cooperating with said body fabric to form a pocket, said pocket comprising a container-receiving mouth and attached sides; and (c) means for opening the mouth of said pocket such that the fluid container is readily inserted by the wearer into said pocket of said sports top during wear.

13. A combination according to claim 12, and comprising an insulating layer located between said body fabric and said pocket panel.

14. A combination according to claim 13, wherein said insulating layer comprises polyester fibers.

15. A combination according to claim 12, wherein said body fabric comprises elastic fibers.

16. A combination according to claim 12, wherein said body fabric comprises first and second shoulder straps for supporting the front and back in position on the wearer.

17. A combination according to claim 16, wherein said pocket panel is sewn to an inside of the back of said body fabric, and comprises first and second shoulder extensions sewn to respective shoulder straps of the body fabric.

18. A garment adapted for releasably holding a fluid container, comprising:

(a) a body fabric for being worn by a wearer;

(b) a pocket panel formed with said body fabric, and cooperating with said body fabric to form a pocket, said pocket comprising a container-receiving mouth and attached sides; and (c) means for opening the mouth of said pocket such that the fluid container is readily inserted by the wearer into said pocket of said garment during wear.

19. A garment according to claim 18, wherein said means for opening the mouth of said pocket comprises a curved, shape-retaining insert.

20. A method for carrying a beverage while jogging, comprising the steps of:

(a) wearing a sports top;

(b) inserting a fluid container in a pocket formed with the sports top, the pocket having a container-receiving mouth and means for opening the mouth to allow ready insertion of the fluid container in the pocket while jogging;

(c) removing the fluid container from the pocket for drinking; and (d) after drinking, reinserting the fluid container in the pocket through the open mouth of the pocket.

* * * * *